US010234097B2

(12) United States Patent
De Bevilacqua et al.

(10) Patent No.: US 10,234,097 B2
(45) Date of Patent: Mar. 19, 2019

(54) LED LIGHTING DEVICE

(71) Applicant: ARTEMIDE S.p.A., Milan (IT)

(72) Inventors: Carlotta Francesca Isolina Maria De Bevilacqua, Milan (IT); Roberto Efrem Franzosi, Milan (IT)

(73) Assignee: ARTEMIDE S.P.A. (IT)

( * ) Notice: Subject to any disclaimer, the term of this patent is extended or adjusted under 35 U.S.C. 154(b) by 36 days.

(21) Appl. No.: 15/455,383

(22) Filed: Mar. 10, 2017

(65) Prior Publication Data

US 2017/0261177 A1 Sep. 14, 2017

(30) Foreign Application Priority Data

Mar. 11, 2016 (IT) ..... 10201625996

(51) Int. Cl.

| | |
|---|---|
| ***F21V 3/02*** | (2006.01) |
| ***F21V 7/22*** | (2018.01) |
| ***F21V 19/00*** | (2006.01) |
| ***F21V 3/06*** | (2018.01) |
| ***F21V 3/10*** | (2018.01) |
| *F21Y 115/10* | (2016.01) |
| *F21S 2/00* | (2016.01) |
| *F21V 21/005* | (2006.01) |
| *F21V 21/096* | (2006.01) |
| *F21Y 103/10* | (2016.01) |
| *F21Y 107/90* | (2016.01) |

(52) U.S. Cl.

CPC ..... *F21V 3/02* (2013.01); *F21V 3/06* (2018.02); *F21V 3/10* (2018.02); *F21V 7/22* (2013.01); *F21V 19/003* (2013.01); *F21S 2/005* (2013.01); *F21V 21/005* (2013.01); *F21V 21/096* (2013.01); *F21Y 2103/10* (2016.08); *F21Y 2107/90* (2016.08); *F21Y 2115/10* (2016.08)

(58) Field of Classification Search

CPC . F21V 3/02; F21V 19/003; F21V 7/22; F21Y 2115/10

See application file for complete search history.

(56) References Cited

U.S. PATENT DOCUMENTS

| | | | | |
|---|---|---|---|---|
| 2012/0281407 | A1* | 11/2012 | Sinofsky ..... | F21S 8/033 362/247 |
| 2013/0021777 | A1 | 1/2013 | Pickard et al. | |
| 2013/0044476 | A1 | 2/2013 | Bretschneider et al. | |
| 2013/0155646 | A1 | 6/2013 | Zhang | |

FOREIGN PATENT DOCUMENTS

| | | |
|---|---|---|
| WO | 2012073556 | 6/2012 |
| WO | 2015066069 | 5/2015 |

OTHER PUBLICATIONS

Corresponding Italian Search Report for ITUA20161589 dated Aug. 31, 2016.

* cited by examiner

*Primary Examiner* — David V Bruce
(74) *Attorney, Agent, or Firm* — The Belles Group, P.C.

(57) ABSTRACT

A LED lighting device comprises a lighting body extending along an axis and internally provided with a chamber housing a LED light source and is delimited by at least one lateral wall consisting of a diffuser having an outer surface defining an emission surface of the device; the diffuser is an opaline diffuser having a transmission coefficient greater than or equal to 50% and a reflection coefficient greater than or equal to 45%.

9 Claims, 3 Drawing Sheets

LED LIGHTING DEVICE

PRIORITY CLAIM

This application claims priority from Italian Patent Application No. 102016000025996 filed on Mar. 11, 2016, the disclosure of which is incorporated by reference.

TECHNICAL FIELD

The present invention relates to a LED lighting device.

BACKGROUND OF THE INVENTION

It is well known that LED light sources are increasingly widespread in the lighting industry. However, the use of LEDs still has some drawbacks, in particular due to the essentially point-like nature of LEDs and the resulting difficulties to obtain lighting surfaces which are homogeneous and evenly lit, but also with high lighting capacity (intensity).

On the other hand, in the lighting industry there is a constant search for technical solutions, which also allow obtaining newly-designed shapes and luminous effects, in which field, in addition to the purely functional aspect, also the aesthetic and emotional component has a key role.

Ultimately, known lighting devices appear to still have room for improvement.

SUMMARY OF THE INVENTION

It is an object of the present invention to provide a LED lighting device, which allows overcoming the drawbacks of the prior art described herein.

In particular, it is an object of the invention to provide a lighting device, which is easy to manufacture and use and has high lighting homogeneity and uniformity, and high lighting efficiency and intensity.

The present invention therefore relates to a lighting device as defined in appended claim 1.

Further preferred features of the invention are defined in the dependent claims.

Compared to prior art systems, the invention provides a simple and functional solution which, in particular, combines high lighting homogeneity and uniformity with high efficiency and lends itself to the production of lighting devices which can take various shapes and configurations and provide original and attractive luminous effects.

BRIEF DESCRIPTION OF THE DRAWINGS

Further features and advantages of the present invention will be apparent from the following description of a preferred non-limiting embodiment thereof, with reference to the figures of the accompanying drawings, wherein.

DETAILED DESCRIPTION OF THE INVENTION

Figure 1:
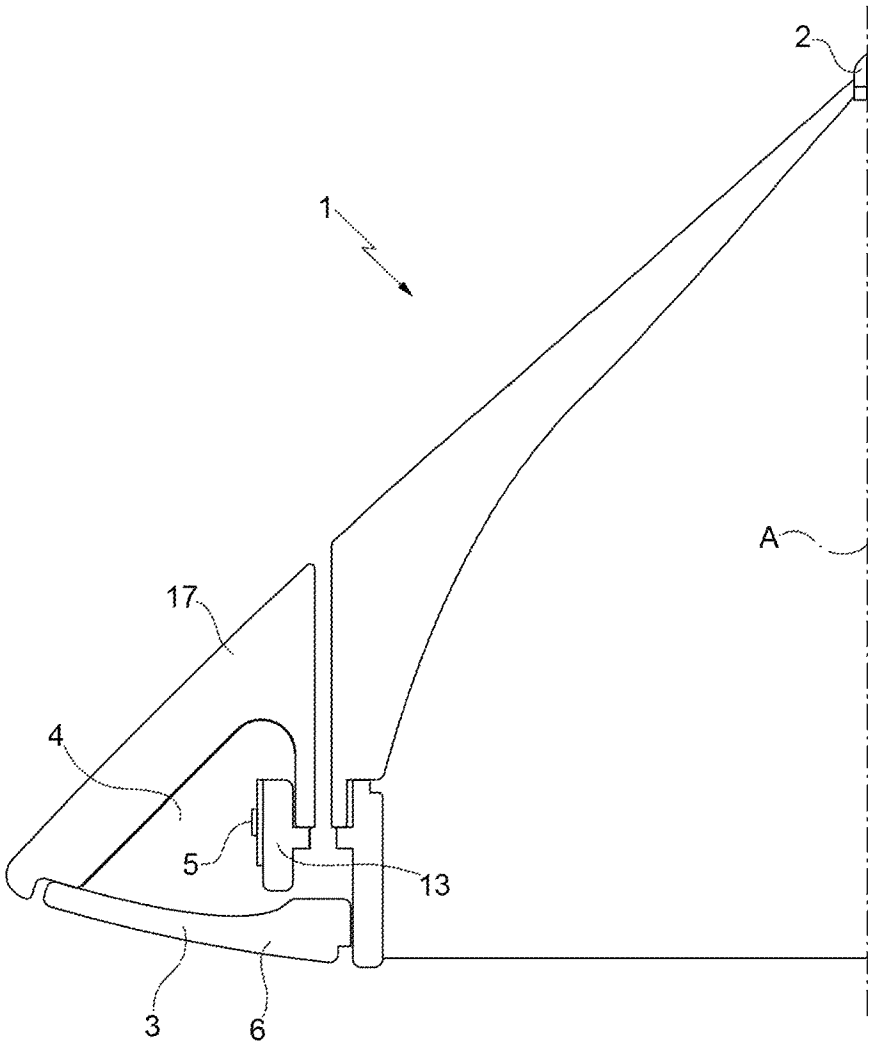
FIG. 1 is a partial schematic longitudinal section view of a LED lighting device according to a first embodiment of the invention.

Referring to FIG. 1, a LED lighting device 1 comprises a support structure 2 and a lighting body 3 supported by the support structure 2.

The support structure 2, only schematically and partially shown in FIG. 1, may take various shapes, also depending on the intended purpose of the device 1 (which may serve as a swinging lamp, a floor lamp, etc.).

The lighting body 3 is shaped as a ring about a longitudinal axis A of the device 1 and is a hollow body having an inner annular (toroidal) chamber 4.

Figure 2:
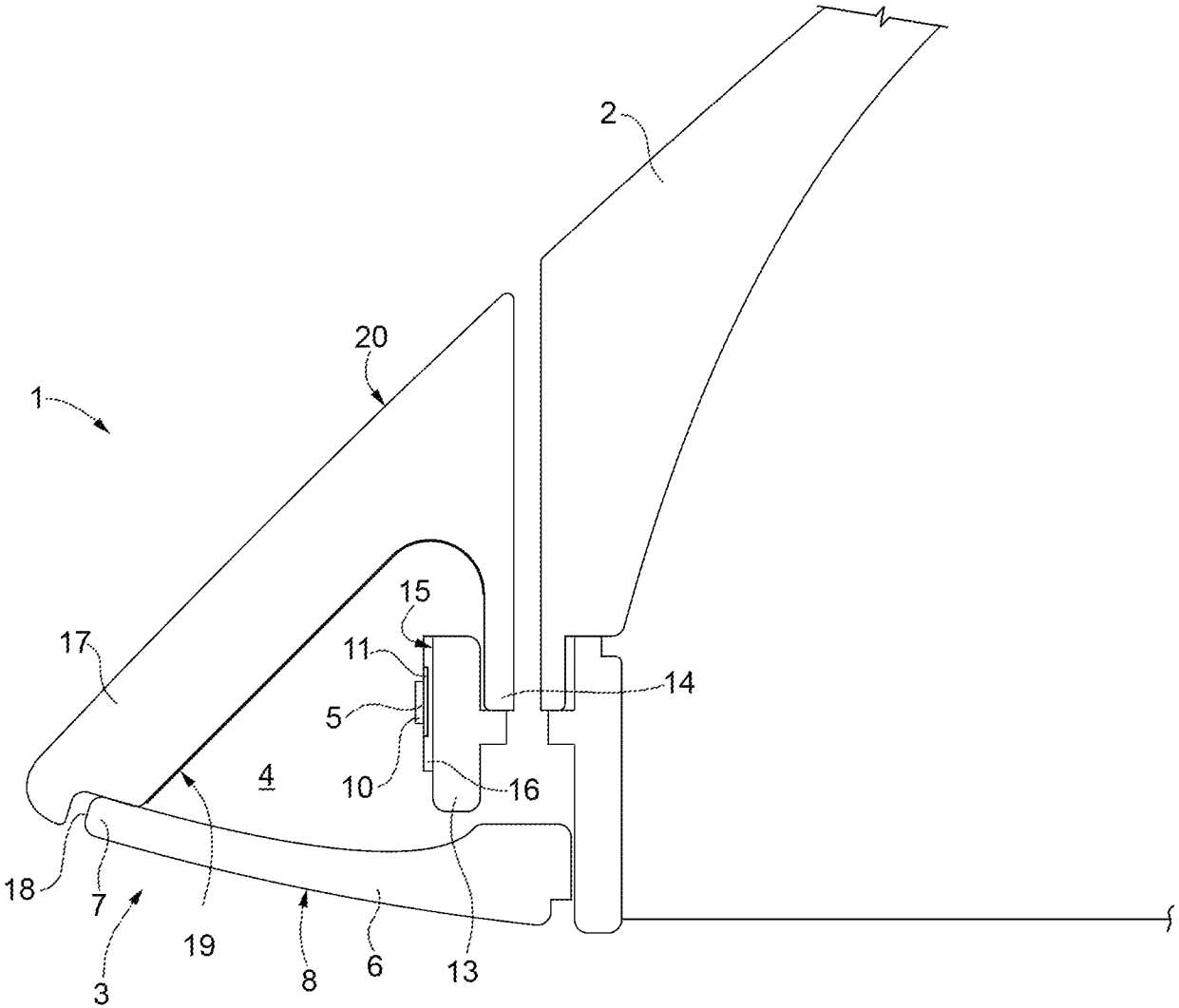
FIG. 2 is a view in enlarged scale of a detail of the lighting device of FIG. 1.

Referring also to FIG. 2, the lighting body 3 comprises a LED light source 5, housed in the chamber 4, and a diffuser 6, which constitutes a wall 7 of the chamber and is provided with an outer surface 8 defining an emission surface of the device 1.

The source 5 is shaped as a ring about axis A and comprises a plurality of LEDs 10 angularly spaced apart from one another.

Advantageously, the LEDs 10 are arranged on a LED strip 11 consisting of a flexible band carrying a succession of LEDs 10 connected by a circuit or electronic board.

In particular, the LEDs 10 are mounted, via the LED strip 11, on an annular support 13, for example made of aluminum, which also serves as a thermal dissipator and extends along a radially inner lateral edge 14 of the lighting body 3.

In the example of FIGS. 1-2, the LEDs 10 are positioned on one face 15 of the support 13; the face 15 is substantially parallel to axis A and the LEDs 10 have a radial arrangement (i.e. are radially oriented) with respect to axis A.

Preferably, the face 15 from which the LEDs 10 extend is covered by a diffusing coating 16, made of a diffusing white material and having high reflectance, i.e. having a reflection coefficient of at least 95%, preferably greater than or equal to 98%.

The diffuser 6 has the shape of an annular disc about axis A and inferiorly delimits the chamber 4, constituting its bottom wall 7.

The diffuser 6, for example made of a polymeric material, has a transmission coefficient greater than or equal to 50% and a reflection coefficient greater than or equal to 45% (and an absorption coefficient not exceeding 5%).

In particular, the diffuser 6 is an opaline diffuser.

Preferably, the diffuser 6 extends below the source 5 and in general below the support 13 and protrudes radially towards the interior with respect to the source 5 and the support 13.

The chamber 4 is delimited by the diffuser 6 (provided with the emission surface 8) and the edge 14 (which carries the source 5) and also by a further wall 17, which is at least partly transparent.

In the example shown in FIGS. 1-2, the wall 17 is a lateral, substantially ring-shaped wall and joins a radially external peripheral edge 18 of the diffuser 6 to the edge 14.

Preferably, the wall 17 is made of a transparent material, for example a polymeric material, and is provided with an inner reflecting coating 19, facing the chamber 4 and having a reflection coefficient greater than or equal to 80% and a transmission coefficient greater than or equal to 15%.

Ultimately, the lighting body 3 has low light absorption inner surfaces (absorption coefficient not exceeding 5%) and thus exhibits, overall, high optical performance; at the same time, the lighting body 3 has high uniformity of the emission surface, defined by the surface 8 of the diffuser 6 and from which the main fraction of the light emitted by the source 5 comes out.

In fact, the light emitted by the source 5 in the chamber hits the diffuser 6, the reflecting coating 19 of the wall 17 and the diffusing coating 16 on the support 13.

Each light beam that hits the diffuser 6 is in small part absorbed and the rest is transmitted or reflected. The light transmitted through the diffuser 6 is emitted from the surface 8, the reflected light is however reused in the chamber 4 and is not lost.

The effectiveness of the device 1 is increased by the presence of the coating 16 and the coating 19, which send back the light, after further reflections, onto the diffuser 6.

Instead, part of the light emitted by the source 5 exits the wall 17 through an outer surface 20 of the wall 17, creating a further less intense luminous effect with respect to the surface 8.

Figure 3:
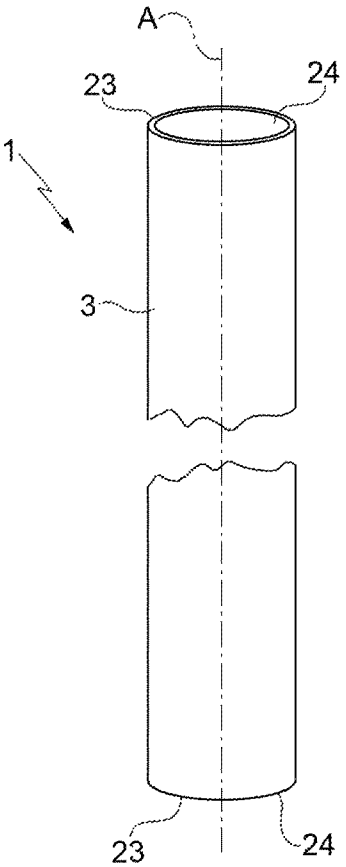
FIG. 3 is a side view of a lighting device according to a second embodiment of the invention.
Figure 4:
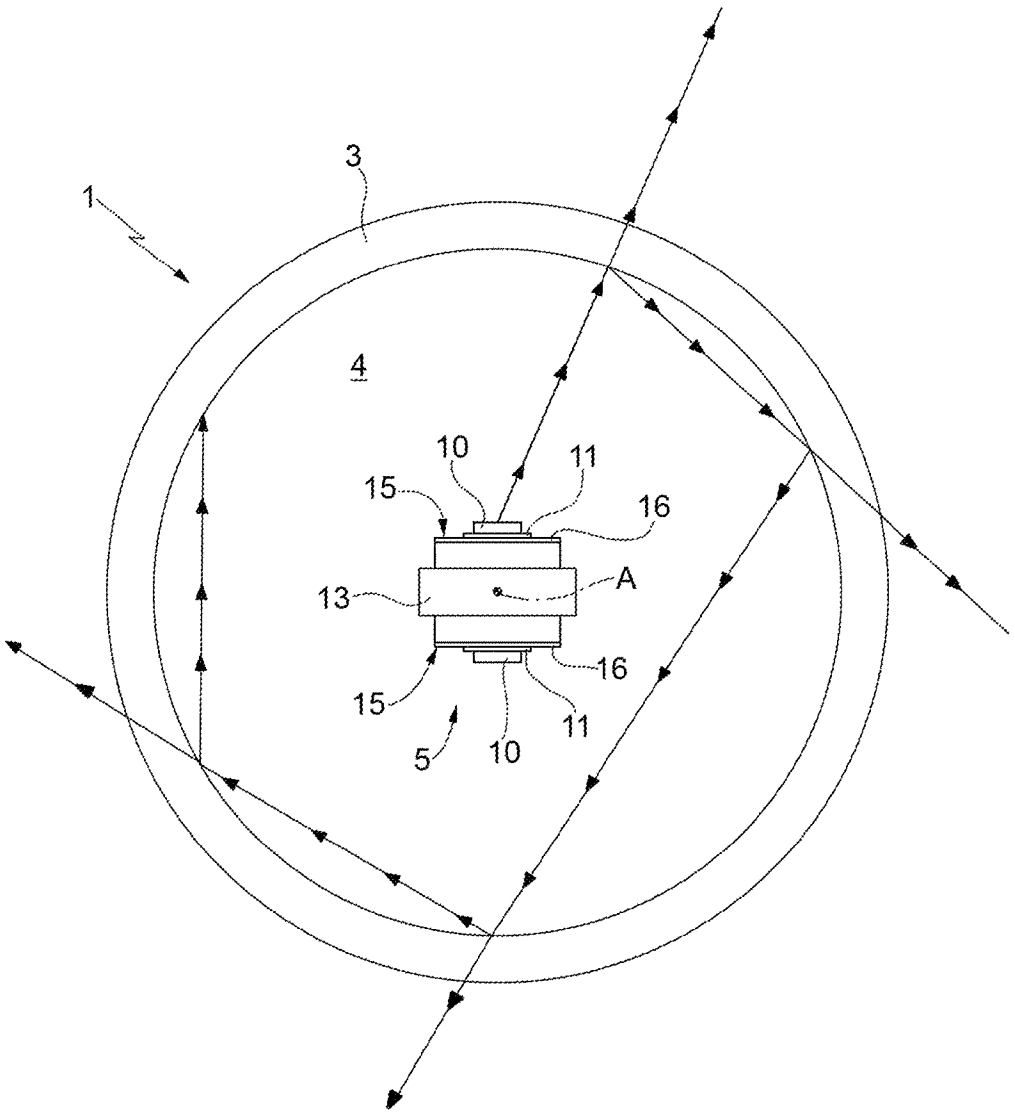
FIG. 4 is a cross-sectional view of the lighting device of FIG. 3.

In the embodiment of FIGS. 3-4, in which any details similar to or identical with those already described are indicated with the same reference numbers, the LED lighting device 1 has a substantially tubular shape about axis A.

In particular, the lighting body 3 is a hollow body that is substantially tubular, which extends along and about the longitudinal axis A of the device 1 and has an inner chamber 4, that is also tubular.

The lighting body 3 further comprises a LED light source 5, housed in the chamber 4, and a diffuser 6, which constitutes a wall 7 of the chamber 4 and is provided with an outer surface 8 defining an emission surface of the device 1.

In this embodiment, the wall 7 is a substantially cylindrical lateral wall of the lighting body 3, closed at respective opposite axial ends 23 by two discs 24 joined to respective end edges of the wall 7.

The source 5 extends parallel to axis A and comprises a plurality of LEDs 10 longitudinally spaced apart from one another parallel to axis A.

Advantageously, the source 5 comprises two series of diametrically opposite LEDs 10, arranged on respective LED strips 11.

The two LED strips 11 and thus the LEDs 10, in particular, are mounted on respective opposite faces 15 of a central longitudinal support 13 which extends along axis A and is supported, for example, by the discs 24. In this case too, the support 13, for example made of aluminum, also serves as a thermal dissipator.

In the example of FIGS. 3-4, the faces 15 are substantially parallel to axis A and the LEDs 10 still have a radial arrangement (i.e. are radially oriented) with respect to axis A.

Preferably, in this case too, the faces 15 from which the LEDs 10 extend are provided with a diffusing coating 16, made of a diffusing white material with high reflectance (reflection coefficient of at least 95%, preferably greater than or equal to 98%).

The diffuser 6 has a tubular shape about axis A and laterally delimits the chamber 4, constituting its lateral wall 7.

Also in this case, the diffuser 6 is an opaline diffuser, for example made of a polymeric material, and has a transmission coefficient greater than or equal to 50% and a reflection coefficient greater than or equal to 45% (and an absorption coefficient not exceeding 5%).

The diffuser 6 has an outer surface 8, which defines the emission surface of the device 1 and is, in this case, a tubular surface.

The chamber 4 is delimited by the diffuser 6 (provided with the surface 8) and also by the discs 24.

Preferably, the discs 24 are made, at least in part, of a transparent material, for example a polymeric material, and therefore constitute further, at least partly transparent walls 17 of the chamber 4, which are preferably provided with respective inner reflecting coatings 19 facing the chamber 4 and having a reflection coefficient greater than or equal to 80% and a transmission coefficient greater than or equal to 15%.

The device 1 shown in FIGS. 3-4 is particularly suitable to provide a modular sectional system.

For example, the modular system comprises two types of modules: a linear module, as schematically shown in FIG. 3 (extending along a rectilinear axis A and having a predetermined length L) and a curved module, not shown (having the shape of an arc of a circle and a radius equal to the length L of the linear module and thus extending along a curvilinear axis A).

By combining two or more linear and/or curved modules, it is possible to form lighting devices of various shapes and sizes and, in particular, having shapes of letters, i.e. create a luminous font (set of writing characters).

The modules can be connected to one another by means of the discs 24 located at their ends. For this purpose, the discs 24 of each module (i.e. of each lighting body 3) are equipped with male/female mechanically-connecting magnetic elements (each module having male and female elements placed at respective opposite ends 23, i.e. on the discs 24 located at the opposite ends 23); and with electrical contacts, for example spring contacts, for the electrical connection of the modules.

Lastly, it is understood that the lighting device as described and illustrated herein can be subject to further modifications and variations that do not depart from the scope of the accompanying claims.

The invention claimed is:

1. A LED lighting device comprising a lighting body extending substantially along an axis and internally provided with a chamber housing a LED light source comprising a plurality of LEDs; the chamber being delimited by at least one lateral wall defined by a diffuser having an outer surface defining an emission surface of the device; wherein the diffuser has a transmission coefficient greater than or equal to 50% and a reflection coefficient greater than or equal to 45%; and wherein the chamber is also delimited by a further wall, made of a material which is at least partly transparent, and provided with an inner reflecting coating, facing the chamber and having a reflection coefficient greater than or equal to 80% and a transmission coefficient greater than or equal to 15%.

2. A device according to claim 1, wherein the diffuser has an absorption coefficient not exceeding 5%.

3. A device according to claim 1, wherein the LEDs are arranged on one or more LED strips.

4. A device according to claim 1, wherein the LEDs extend from a face of a support, said face being covered by a diffusing coating having a reflection coefficient of at least 95%.

5. A device according to claim 1, wherein the LEDs have a radial arrangement with respect to the axis.

6. A LED lighting device comprising a lighting body extending substantially along an axis and internally provided with a chamber housing a LED light source comprising a plurality of LEDs; the chamber being delimited by at least one lateral wall defined by a diffuser having an outer surface defining an emission surface of the device; wherein the diffuser has a transmission coefficient greater than or equal to 50% and a reflection coefficient greater than or equal to 45%; wherein the lighting body is substantially ring-shaped about the axis and the chamber is a substantially annular chamber; the LED light source being substantially ring-shaped about the axis and the plurality of LEDs being angularly spaced apart from one another about the axis; and the diffuser having the shape of a substantially annular disc about the axis.

7. A LED lighting device comprising a lighting body extending substantially along an axis and internally provided with a chamber housing a LED light source comprising a plurality of LEDs; the chamber being delimited by at least one lateral wall defined by a diffuser having an outer surface defining an emission surface of the device; wherein the diffuser has a transmission coefficient greater than or equal to 50% and a reflection coefficient greater than or equal to 45%; wherein the lighting body is a substantially tubular hollow body, rectilinear or curved, which extends along and about the axis; the diffuser having a tubular shape about the axis and laterally delimiting the chamber; the diffuser defining a lateral wall closed at respective opposite axial ends by two discs joined to respective end edges of the lateral wall; the LED light source extending parallel to the axis and the plurality of LEDs longitudinally spaced apart from one another parallel to the axis.

8. A device according to claim 7, wherein the LED light source comprises two series of diametrically opposite LEDs which project from respective opposite faces of a central longitudinal support extending along the axis.

9. A device according to claim 4 wherein the reflection coefficient is greater than or equal to 98%.

* * * * *